US005631450A

United States Patent [19]

Itakura

[11] Patent Number: 5,631,450

[45] Date of Patent: May 20, 1997

[54] MEGAPHONE

[76] Inventor: Hiromasa Itakura, Minamimachi 18, Oaza Kunotsubo, Nishiharu-cho, Nishikasugai-gun, Aichi-ken 481, Japan

[21] Appl. No.: 399,377

[22] Filed: Mar. 2, 1995

[30] Foreign Application Priority Data

Mar. 7, 1994 [JP] Japan ..... 6-064495

[51] Int. Cl.[6] ..... G10K 11/00

[52] U.S. Cl. ..... 181/189; 181/190; 181/192; 181/182

[58] Field of Search ..... 181/178, 182, 181/185, 186, 187, 188, 189, 190, 192, 195; D14/208

[56] References Cited

U.S. PATENT DOCUMENTS

| | | | |
|---|---|---|---|
| 4,703,829 | 11/1987 | Hardt | 181/178 |
| 5,094,317 | 3/1992 | Ladendorf | 181/178 |
| 5,160,815 | 11/1992 | Prater | 181/182 |

*Primary Examiner*—Khanh Dang

*Attorney, Agent, or Firm*—Flynn, Thiel, Boutell & Tanis, P.C.

[57] ABSTRACT

A megaphone includes a pair of hollow bodies which are assembled at a connecting portion to open and close freely, wherein a tuning part is formed by denting the center of a flat part of each hemiconical main part to provide a level face around the tuning part.

9 Claims, 5 Drawing Sheets

MEGAPHONE

BACKGROUND OF THE INVENTION

1. Field of the Invention

The present invention relates to an improved megaphone to be used as a megaphone, percussion instrument or V-sign object for cheering during a game, or as a room ornament.

2. Prior Art

A cone-shaped device has been known as a megaphone for cheering during a game, however, such a device has only a function to intensify or direct the voice. In the case of making a sound, it is necessary to beat the megaphone with a palm of the hand.

SUMMARY OF THE INVENTION

It is therefore an object of the present invention to provide a magaphone, which (1) generated percussion sounds in a clear low tone by utilizing a tuning part, (2) prevents a flat part from bending, (3) restrains the voice from escaping out of a reinforced mouthpiece which is hard to transform, and (4) is easily assembled with a spring pin.

To overcome the above shortcomings, a megaphone according to the present invention (1) improves the quality of sound, (2) reinforces the hardness by forming a tuning part and a flat part which cause the percussion sound of a megaphone, and (3) restrains the voice from escaping out of a mouthpiece by reinforcing the mouthpiece.

A megaphone according to the present invention is assembled by connecting two hollow bodies at a connecting portion with a spring pin, thereby allowing the two hollow bodies to open and close freely. Moreover, a tuning part is formed by denting the center of a flat part of a hemiconial main part to provide a level face arround the tuning part. And a notch is formed at the tip side in a hemiconical mouthpiece.

The above and other objects, features and advantages of the present invention will become more apparent from the following description when taken in conjunction with the accompanying drawings in which preferred embodiments of the present invention are shown by way of illustrative examples.

DESCRIPTION OF THE PREFERRED EMBODIMENT

Figure 1:
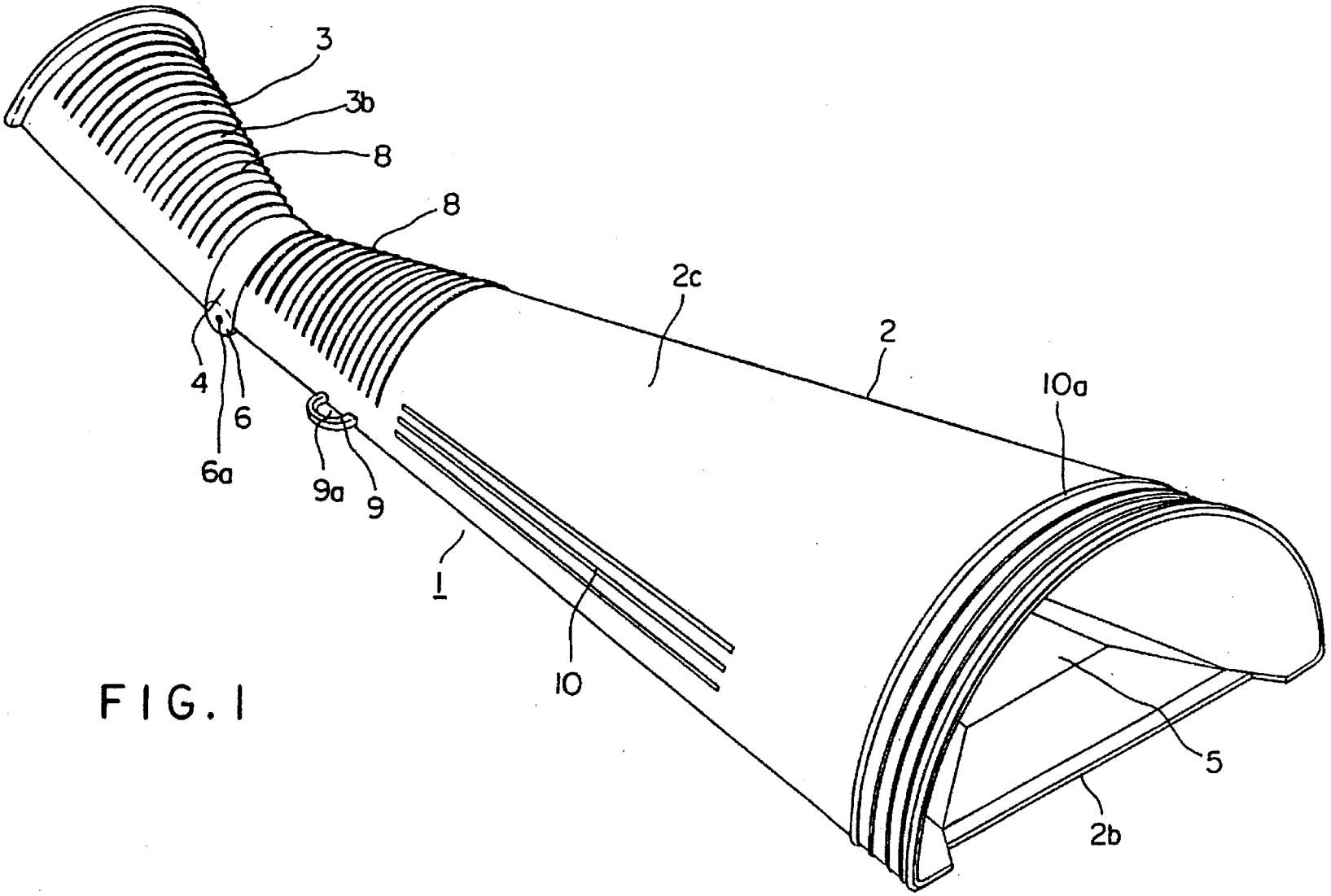
FIG. 1 is an isometric view of a body of a megaphone according to the present invention.
Figure 2:
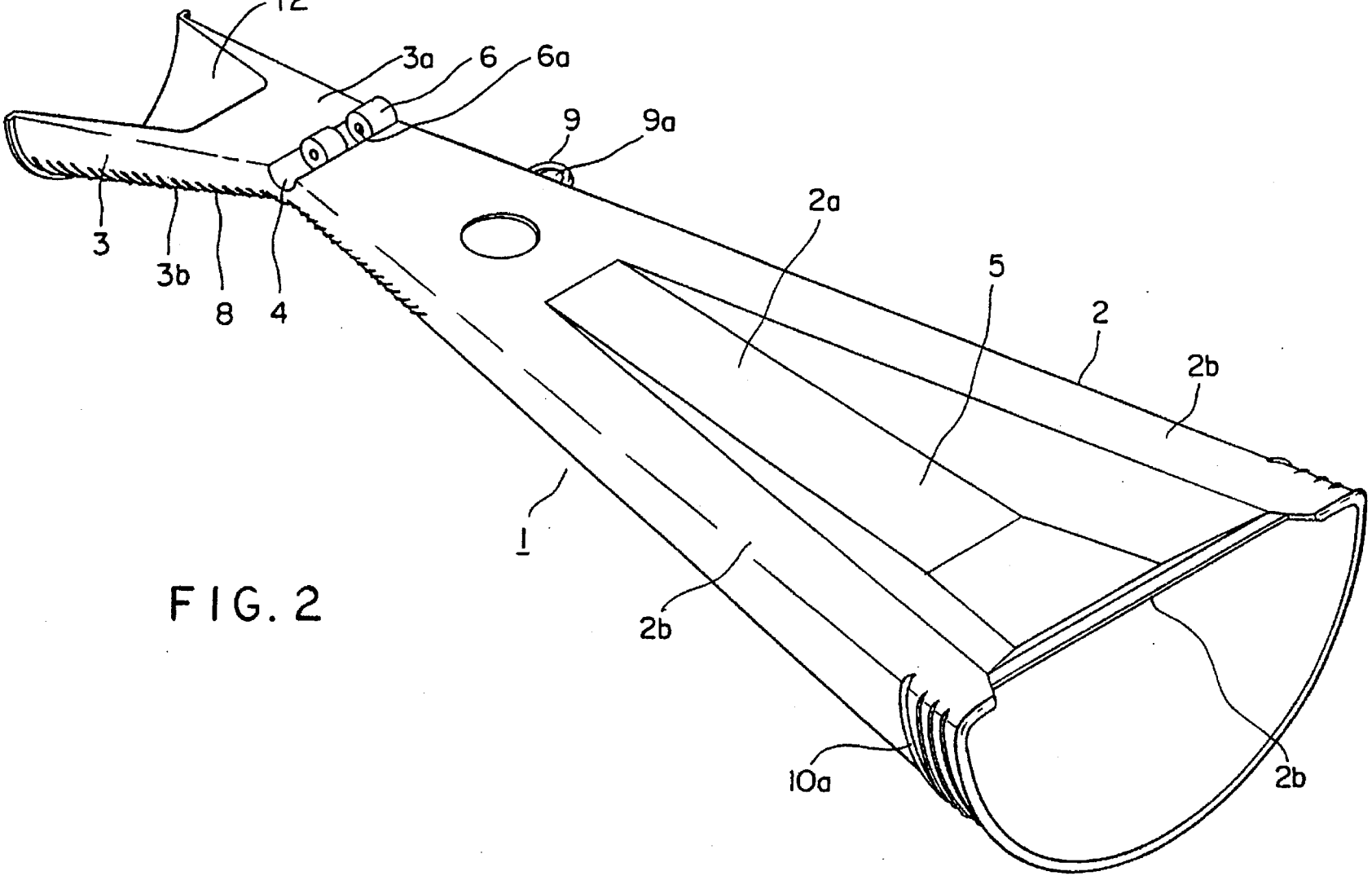
FIG. 2 is other isometric view of a body of a megaphone shown in FIG. 1.
Figure 3:
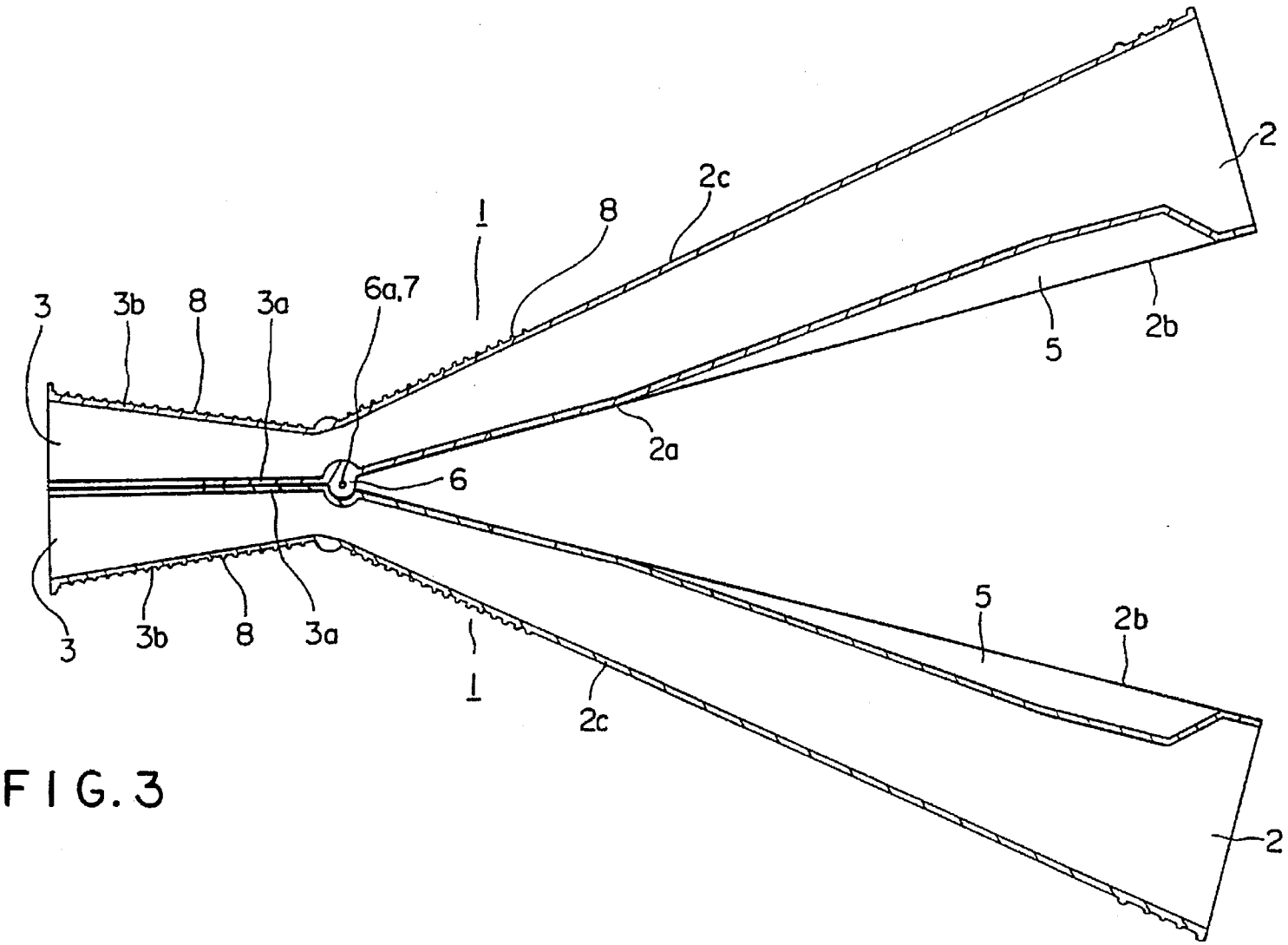
FIG. 3 is a cross sectional view of a megaphone.
Figure 4:
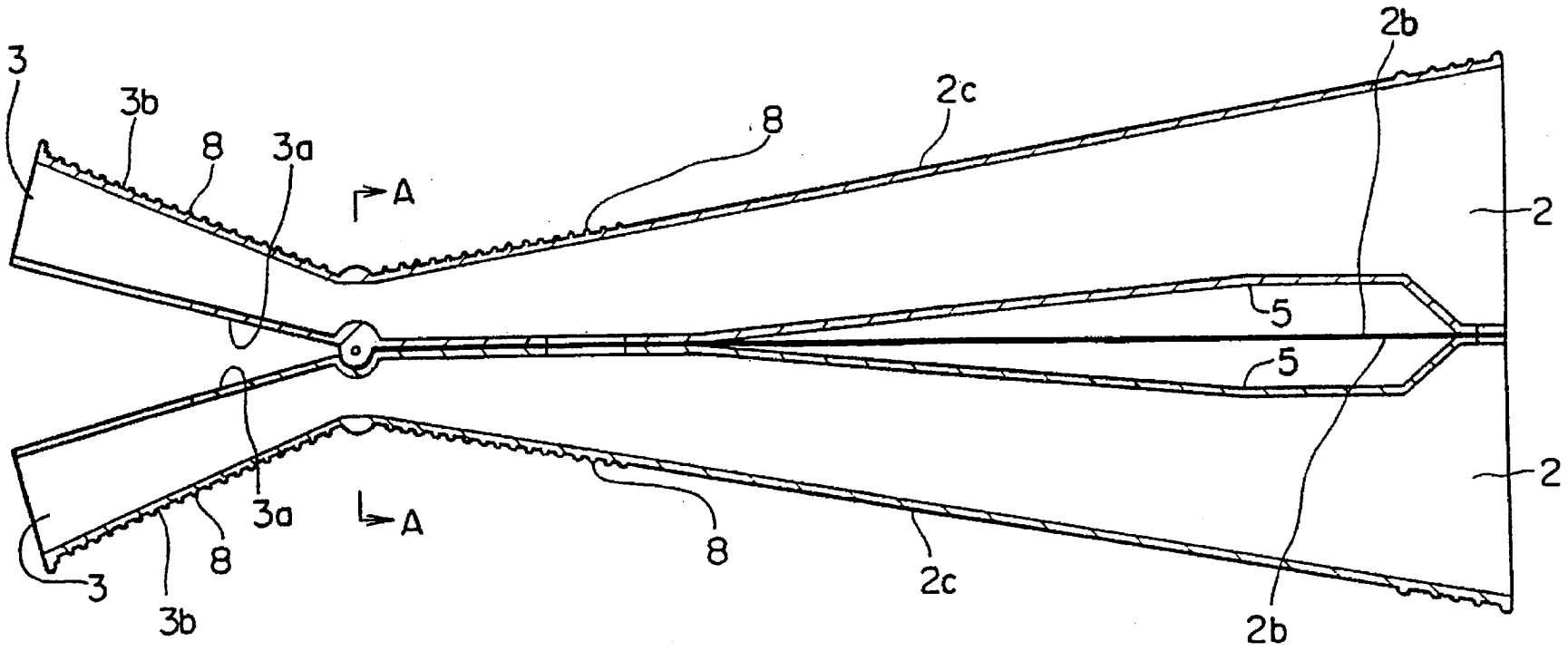
FIG. 4 is a cross sectional view of a megaphone.
Figure 5:
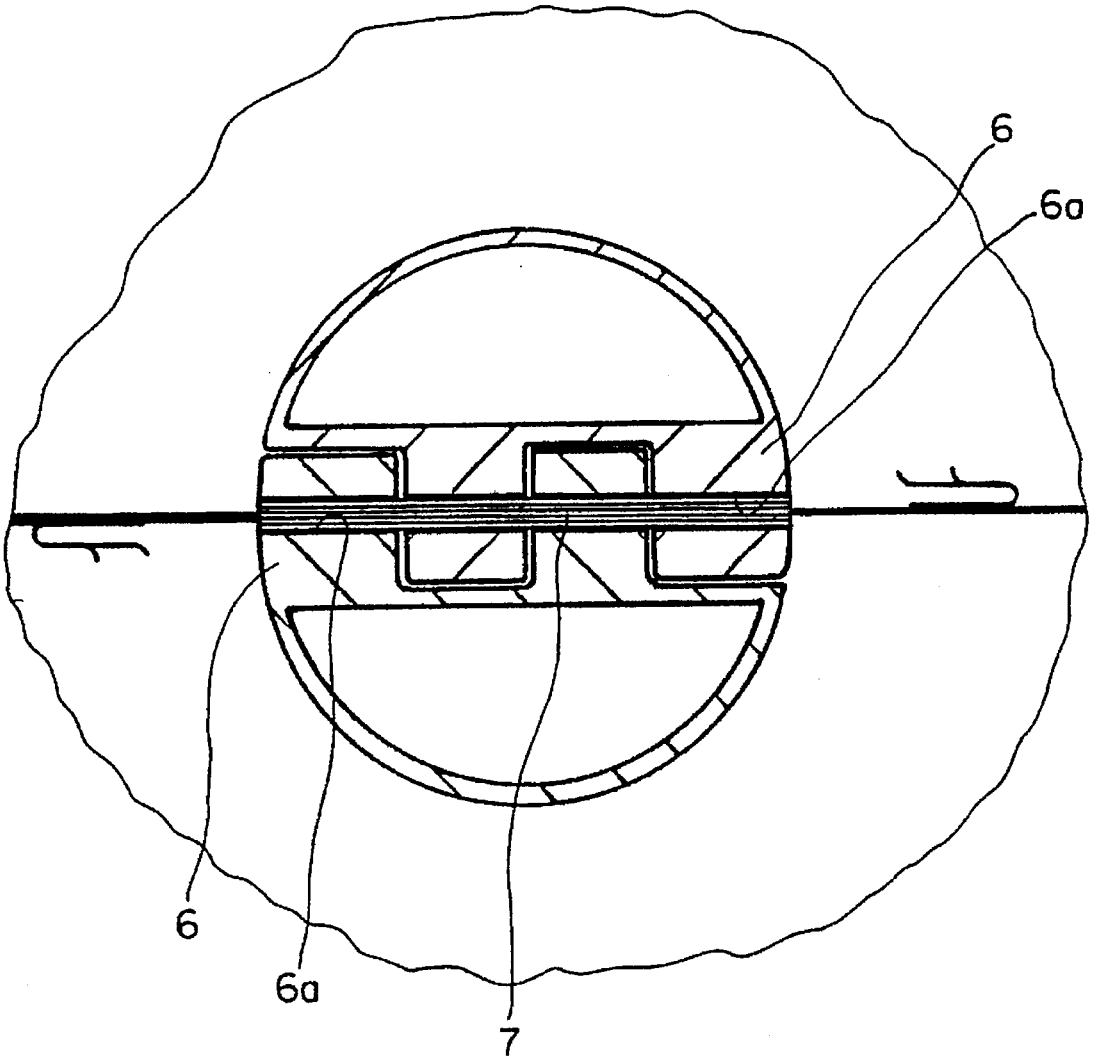
FIG. 5 is a cross sectional view taken along the line A—A shown in FIG. 4.

A megaphone according to the present invention will be described with reference to FIG. 1 to FIG. 5.

The reference numeral 1 represents a plastic body which is unitedly composed of a hemiconical main part 2 and a hemiconical mouthpiece 3. The radii of the main part 2 and the mouthpiece 3 is larger as from the base to the tip. A connecting portion 4 is arranged at the boundary between a flat part 2*a* of the main part 2 and a flat part 3*a* of the mouthpiece 3.

Moreover, the reference numeral 5 represents a tuning part which is formed by denting the center of the flat part 2*a* of the main part 2 deeply thereby creating a level face 2*b* of the flat part 2*a* around the tuning part 5. The width of the tuning part 5 is wider as from the base to the tip. A notch 12 is provided in the flat part 3*a* of the mouthpiece 3.

Furthermore, a hinge 6 is attached at the connecting portion 4 of the body 1. A spring pin 7 is inserted through holes 6*a* of the hinge 6. As a result, a pair of the bodies 1 opens and closes freely at the connecting portion 4. At the time the flat parts 2*a* of the main parts 2 of the said bodies 1 is joined to each other, a cone-shaped megaphone is formed.

The reference numeral 8 represents knurls which are arranged on the arc face 2*c* of the main part 2 and the arc face 3*b* of the mouthpiece 3. The knurls 8 has a function to prevent the hand from slipping. The projection 9 has the hole 9*a* to pass a string through so that a megaphone according to the present invention is very portable.

The reference numerals 10, 10*a* represent decorative projecting lines which are arranged at the tip and both sides of the arc face 2*c* of the main parts 2.

Moreover, an operation of a megaphone according to the present invention will be described hereafter.

A pair of the bodies 1 is connected at the connecting portion 4 with the spring pin 7 thereby allowing the bodies 1 to open and close freely. The bodies 1 become a cone-shaped megaphone by joining the flat parts 2*a* of the main parts 2, and a V-sign object by joining the flat parts 3*a* of the mouthpieces 3. In the case of using the V-shaped bodies as a megaphone, the cheering voice is widely intensified and directed through the main parts 2.

Furthermore, the aforementioned megaphone can be used as a percussion instrument by joining the flat parts 3*a* of the mouthpieces 3 to form the V-shaped bodies 1 and then handling the bodies 1 so as to open and close repeatedly in order to percuss the flat parts 2*a*. And the tuning part 5 is formed in the flat part 2*a* so that the quality of the percussion sound is a better low tone than the sound created by percussing two flat faces.

Moreover, the level face 2*b* of the flat part 2*a*, which surrounds the tuning part 5, has a function to reinforce the flat part 2*a* of the plastic body 1 which is easily transformed. The flat part 3*a* functions to reinforce the mouthpiece 3 which is easily transformed.

The V-shaped bodies 1 can be used as a V-sign object for cheering during a game. In addition, the V-shaped bodies 1 is so stably laid that it is possible to use a megaphone as a room ornament.

As mentioned above, a megaphone according to the present invention is assembled by connecting a pair of the hollow bodies 1 at the connecting portion 4 with the spring pin 7 thereby allowing the bodies 1 to open and close freely. The tuning part 5 is formed by denting the center of the flat part 2*a* of the hemiconical main part 2. As a result, the quality of the percussion sound is a better low tone than the sound created by percussing two flat faces of a conventional megaphone. And the level face 2*b* surrounds the tuning part 5 so that it is possible to prevent the flat part 2*a* from curving and to reinforce the flat part 2*a* of the plastic body 1 which is easily transformed.

Furthermore, a notch 12 is formed in the flat part 3*a* of the hemiconic mouthpiece 3. The base and the circumference of the flat part 3*a* have a function to reinforce the mouthpiece 3 so that it is possible to prevent the mouthpiece 3 from being transformed. A pair of the mouthpieces 3 is unitedly adjacent so that it is possible to restrain the voice from escaping out of the mouthpieces 3.

Moreover, the means of connecting a pair of the bodies 1 at the connecting portion 4 is the spring pin 7 so that the bodies 1 are firmly connected with the elasticity of the spring pin 7 even if the hole 6*a* in which the spring pin 7 is inserted isn't minutely formed. And it is possible to assemble a pair of the bodies 1 to produce a megaphone only by inserting the spring pin 7 through the hole 6*a*.

Although the invention has been described in its preferred form with a certain degree of particularity, it is to be understood that the present invention is not limited in practical application to the specific embodiment described herein and many changes and variations are possible in the invention without departing from the scope and spirit therefore.

What is claimed is:

1. A megaphone comprising:

a pair of hollow bodies which include a connecting portion connected therebetween such that said hollow bodies are movably connected together, said hollow bodies being pivotal away from and toward each other to open and close freely, each of said hollow bodies including a hemiconical main part which is defined on one side by a flat part that extends longitudinally between opposite ends of said hemiconical main part, each said hemiconical main part including an indented tuning part which is formed by denting the center of said flat part of each said hemiconical main part such that a level face of said flat part is disposed around the tuning part.

2. A megaphone comprising:

a pair of hollow bodies which include a connecting portion connected therebetween such that said hollow bodies are movably connected together, said hollow bodies being pivotal away from and toward each other to open and close freely, each of said hollow bodies including a hemiconical mouthpiece which is defined on one side by a flat part that extends longitudinally between opposite tip and base ends of said hemiconical mouthpiece, each said flat part including a notch which is formed at the tip end of said hemiconical mouthpiece except sections of said flat part near the base end and the circumference of each said hemiconic mouthpiece partially surround said notch.

3. A megaphone according to claim 1, wherein said pair of hollow bodies are pivotally secured together with a spring pin.

4. A megaphone according to claim 2, wherein said pair of hollow bodies are pivotally secured together with a spring pin.

5. A megaphone comprising:

a pair of hollow bodies which each have an axially elongate hemiconical shape defined by an outward facing arcuate surface, an inward facing flat surface and opposite first and second open ends, said hollow bodies including connecting means disposed proximate one of said first and second open ends for pivotally connecting said hollow bodies together with said flat surfaces disposed in opposing relation, said connecting means defining a pivot axis oriented transverse to a central megaphone axis extending longitudinally between said first and second open ends of said megaphone so that said hollow bodies pivot about said pivot axis and are movable toward and away from each other between open and closed positions.

6. A megaphone according to claim 5, wherein each said hollow body comprises an elongate hemiconical main portion defining said first open end and a hemiconical mouthpiece portion defining said second open end, said connecting means being disposed at a junction between said main portion and said mouthpiece portion such that said pivot axis is spaced longitudinally between said first and second open ends.

7. A megaphone according to claim 6, wherein said flat surface is provided on said main portion and includes an indented tuning part formed by inwardly denting a center portion of said flat surface to facilitate generation of sound when said hollow bodies are pivoted to said closed position.

8. A megaphone according to claim 6, wherein said main portion and said mouthpiece portion are angularly offset from each other about said pivot axis so as to define a V-shape, said main portions being movable toward and away from each other respectively to said closed and open positions as said mouthpiece portions are respectively moved away from and toward each other.

9. A megaphone according to claim 6, wherein said flat surface defines a flat part of each said mouthpiece portion, said flat parts each being notched at said second ends such that said mouthpiece portions are in communication with each other through said notches.

* * * * *